US005261334A

United States Patent [19]

Chevoor

[11] Patent Number: 5,261,334

[45] Date of Patent: Nov. 16, 1993

[54] TABLE OF TWO HEIGHTS

[76] Inventor: Thomas C. Chevoor, 68-B Pickering Wharf, Salem, Mass. 01970

[21] Appl. No.: 839,120

[22] Filed: Feb. 20, 1992

[51] Int. Cl.[5] ..... A47B 3/06

[52] U.S. Cl. ..... 108/153; 108/12; 248/188.2

[58] Field of Search ..... 108/13, , 12, 11, 19, 108/144, 156, 153; 248/188.2, 188.6

[56] References Cited

U.S. PATENT DOCUMENTS

| | | | |
|---|---|---|---|
| 732,585 | 6/1903 | Reinhardt | 108/19 |
| 2,398,693 | 4/1946 | Bureau | 108/111 |
| 3,865,050 | 2/1975 | Cecchetti | 108/19 |
| 4,016,819 | 4/1977 | Cowling | 108/19 |
| 4,564,181 | 1/1986 | Gansel et al. | 108/12 X |
| 4,609,192 | 9/1986 | Bratcher | 108/19 X |
| 4,923,157 | 5/1990 | Belamiza | 248/188.2 |
| 5,060,896 | 10/1991 | Hobbins | 248/188.2 |

*Primary Examiner*—Jose V. Chen

[57] ABSTRACT

A table carries the weight of its table top down through upper leg structures to the bottoms of recipticles in lower leg structures from which it is transferred to the arches of rigid subassemblies and thence to the floor. A lower table top may be obtained from the described table by withdrawing the upper leg structures from the recepticles and setting the lower ends of the upper leg structures directly on the floor.

9 Claims, 2 Drawing Sheets

TABLE OF TWO HEIGHTS

BRIEF SUMMARY OF THE INVENTION

This invention relates to tables such as are used caterers to provide bar service or table service. The table according to the invention, carries the weight of the table top down through upper leg structures to the bottoms of recipticles in lower leg structures from which it is transferred to the arches of rigid subassemblies and thence to the floor. A lower table top may be obtained from the described table by withdrawing the upper leg structures from the recepticles and setting the lower ends of the upper leg structures directly on the floor.

DETAILED DESCRIPTION

Figure 1:
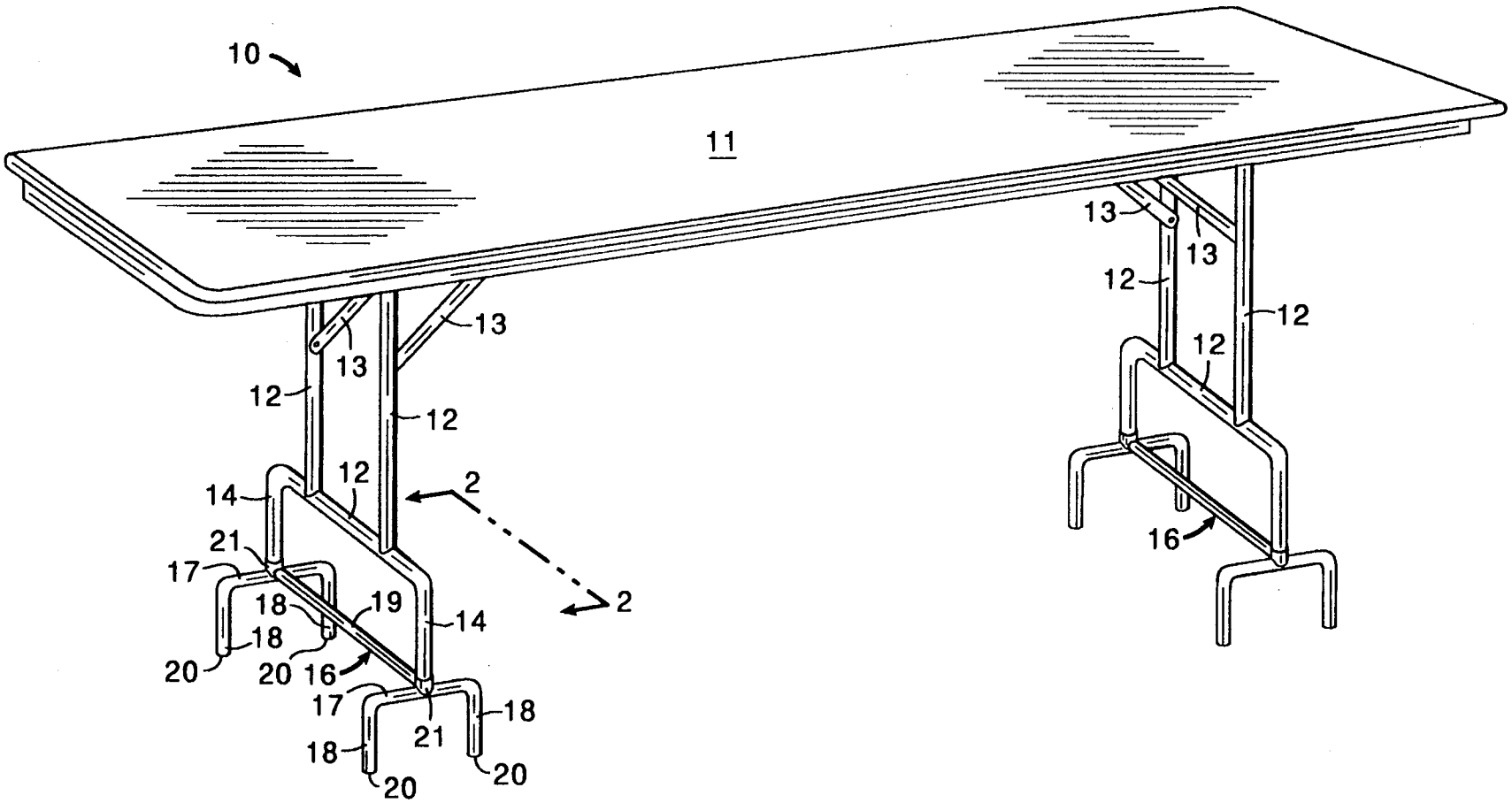
FIG. 1 shows a table according to the invention.
Figure 2:
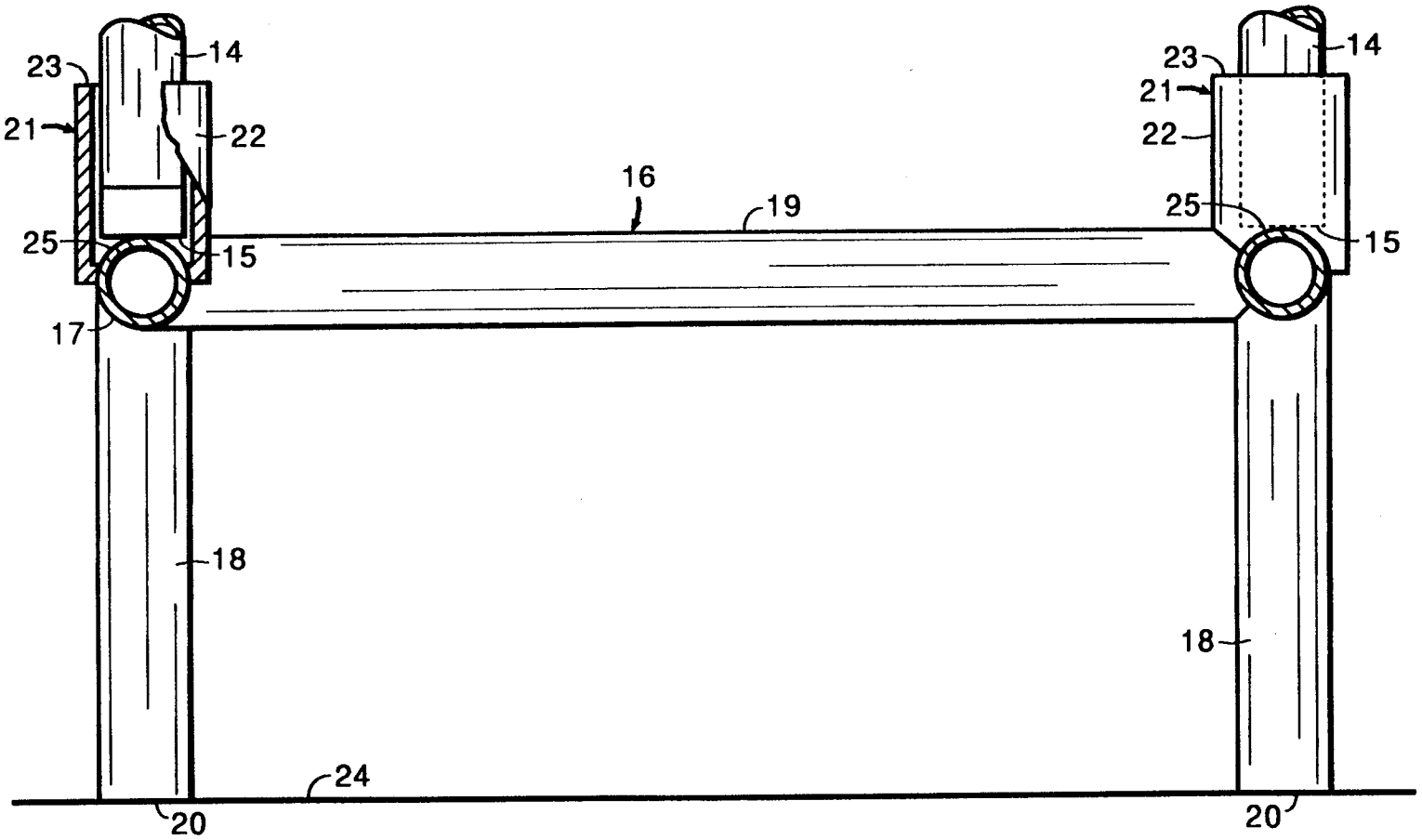
FIG. 2 shows a sectional view of a portion of the table of FIG. 1 with breaking away of portions to reveal internal construction, the section being indicated in FIG. 1.

Referring to the Figures, table 10, according to the invention, includes table top 11 supported through struts 12 and braces 13 on four upper leg structures 14 each with a lower end 15.

Rigid subassemblies 16 each include two planar arches 17 formed from hollow tubing. Arches 17 terminate in lower leg structures 18. Spacer bar 19 holds arches 17 parallel to one another with lower ends 20 of leg structures 18 in a plane 24 of a floor on which table 10 is supported.

Each rigid subassembly 16 includes as parts thereof two recepticles 21 each having generally the form of a tube 22 with open upper end 23. Tubes 22 are affixed as part of assembly 16 so as their axes are perpendicular to plane 24. Recepticles 21 have bottoms 25 which are closed by arches 17. Bottoms 25 of the several recepticles 21 are equally distant from plane 24, and advantageously 13 inches therefrom.

Upper leg structures 14 fit within recepticles 21 with lower ends 15 resting on arches 17, which form bottoms for recepticles 21. Advantageously the inside of recepticles 21 is slightly larger than the outside of lower leg structures 18 so that upper leg structures 14 can enter recepticles 21 without binding.

The table as described above carries the weight of the table top down through the upper leg structures to the bottoms of the recipticles where it is transferred to the arches of the rigid subassemblies and thence to the floor, providing a table with its top at a suitable height for use as a bar service. Upper leg structures 14 may be withdrawn from recepticles 21 and positioned directly on the floor to provide a table with its top at a height suitable for use as a dining table.

What is claimed is:

1. A table comprising a table top, four upper leg structures supporting said table top, each of said four upper leg structures having a lower end, eight lower leg structures each having a lower end, and four recepticles, each recepticle being in the general form of a tube with an axis and having an open upper end and a closed bottom, a first set of four of said lower leg structures and a second set of two of said recepticles being rigidly connected together in a first rigid subassembly, a third set of four of said lower leg structures and a fourth set of two of said recepticles being rigidly connected together in a second rigid subassembly, members of said third set being distinct from members of said first set, and members of said fourth set being distinct from members of said second set, said four upper leg structures, said lower ends of said lower leg structures, and said recepticles being so positioned and oriented with respect to one another that all of the lower ends of said lower leg structures are in a lower plane, and all of the lower ends of said four upper leg structures are in an upper plane, said upper plane and said lower plane being parallel to said table top, all parts of said table are on one side of said lower plane, each of the recepticles has its axis perpendicular to said lower plane, each of the recepticles has its bottom closer than its open end to said lower plane, the bottoms of all said recepticles are positioned at equal distances from said lower plane, the lower ends of said four upper leg structures are inserted respectively within said four recepticles and rest on the bottoms thereof.

2. A table as claimed in claim 1, said first rigid subassembly comprising a first arch of hollow tubing lying in a plane and terminating in two of said lower ends of said lower leg structures, said first arch providing a bottom of one of said recepticles.

3. A table as claimed in claim 2, said first rigid subassembly comprising a second arch of hollow tubing lying in a plane and terminating in two of said lower ends of said lower leg structures, said second arch providing a bottom of one of said recepticles, planes of said first and second arches being maintained parallel by a spacer bar extending therebetween.

4. A table as claimed in claim 3, wherein said second rigid subassembly has substantially the same construction as said first rigid subassembly, and wherein the lower ends of a third and of a fourth of said upper leg structures fit within and rest on the bottoms of recepticles of said second rigid subassembly.

5. A table as claimed in claim 2, wherein said second rigid subassembly has substantially the same construction as said first rigid subassembly, and wherein the lower ends of a third and of a fourth of said upper leg structures fit within and rest on the bottoms of recepticles of said second rigid subassembly.

6. A table as claimed in claim 1, wherein the bottoms of said recepticles are 13 inches from said lower plane.

7. A table as claimed in claim 1, wherein said second rigid subassembly has substantially the same construction as said first rigid subassembly, and wherein the lower ends of a third and of a fourth of said upper leg structures fit within and rest on the bottoms of recepticles of said second rigid subassembly.

8. A table comprising a table top, four upper leg structures supporting said table top, each of said four upper leg structures having a lower end, and a plurality of lower leg structures each having a lower end, the four lower ends of said upper leg structures being in an upper plane, and all of the lower ends of said lower leg structures being in a lower plane, and all parts of said table being on one side of said lower plane, a first set of at least three of said lower leg structures being rigidly connected in a first rigid subassembly, and a second disparate set of at least three of said lower leg structures being rigidly connected in a second rigid subassembly, said first rigid subassembly positioning all the lower ends of its lower leg structures in a plane, said first rigid subassembly including a first recepticle with a bottom, the lower end of a first of said upper leg structures being inserted within said first recepticle and resting on the bottom thereof, said first rigid subassembly further including a second recepticle with a bottom, the lower end of a second of said upper leg structures fitting within said second recepticle and resting on the bottom thereof, said second rigid subassembly positioning all the lower ends of its lower leg structures in a plane, said second rigid subassembly including a third recepticle with a bottom, the lower end of a third of said upper leg structures being inserted within said third recepticle and resting on the bottom thereof, said second rigid subassembly further including a fourth recepticle with a bottom, the lower end of a fourth of said upper leg structures being inserted within said fourth recepticle and resting on the bottom thereof.

9. A table as claimed in claim 8, wherein the bottoms of said recepticles are 13 inches from said plane.

* * * * *